US008646367B2

(12) United States Patent
Senft

(10) Patent No.: US 8,646,367 B2
(45) Date of Patent: Feb. 11, 2014

(54) TRIMMER BLOCK PAD, TRIMMER, AND METHOD OF TRIMMING

(75) Inventor: Jennifer Senft, Thomasville, PA (US)

(73) Assignee: Jenco Microedge, Inc., Thomasville, PA (US)

( * ) Notice: Subject to any disclaimer, the term of this patent is extended or adjusted under 35 U.S.C. 154(b) by 385 days.

(21) Appl. No.: 12/874,621

(22) Filed: Sep. 2, 2010

(65) Prior Publication Data

US 2012/0057951 A1 Mar. 8, 2012

(51) Int. Cl.
*B26D 7/02* (2006.01)
*B26D 5/08* (2006.01)

(52) U.S. Cl.
USPC ..... 83/465; 83/519; 83/214

(58) Field of Classification Search
USPC ..... 83/13, 519, 214, 311, 324, 513, 216, 83/282, 461, 564, 465, 630, 925, 277, 422, 83/267, 436, 155, 9.51, 924, 934, 99, 109, 83/149, 162–165
See application file for complete search history.

(56) References Cited

U.S. PATENT DOCUMENTS

| | | | | |
|---|---|---|---|---|
| 1,757,623 | A | 5/1930 | Frazier | |
| 2,288,304 | A | 6/1942 | Schlattner | |
| 2,350,540 | A | 6/1944 | Spiller et al. | |
| 3,146,650 | A | 9/1964 | Sarring et al. | |
| 3,528,332 | A * | 9/1970 | Des Jardins et al. | 83/214 |
| RE28,840 | E | 6/1976 | Sarring | |
| 3,981,212 | A | 9/1976 | McCain et al. | |
| 4,516,455 | A | 5/1985 | Peters | |
| 6,895,847 | B2 | 5/2005 | Muller | |
| 7,573,618 | B2 | 8/2009 | Tsai et al. | |
| 2003/0113087 | A1 | 6/2003 | Lee et al. | |
| 2006/0140743 | A1 | 6/2006 | Marsh | |
| 2007/0247676 | A1 | 10/2007 | Tsai et al. | |
| 2008/0155832 | A1 * | 7/2008 | Yu et al. | 30/92 |
| 2009/0085271 | A1 | 4/2009 | Nagasawa et al. | |
| 2010/0018368 | A1 * | 1/2010 | Meyer et al. | 83/13 |

FOREIGN PATENT DOCUMENTS

WO 9701857 A1 1/1997

OTHER PUBLICATIONS

Thomas E. Jefferson, Jr., "Pre-made Book Blocks for 3-Knife Trimmers", Binda Block, Inc., Mar. 24, 2010, www.bindablock.com.

* cited by examiner

*Primary Examiner* — Ghassem Alie
(74) *Attorney, Agent, or Firm* — McNees Wallace & Nurick LLC

(57) ABSTRACT

The present disclosure relates to a trimmer block pad, a trimmer, and a process of trimming. The process includes inserting a book into a trimmer, positioning a trimmer block pad to abut the book, the trimmer block comprising a first non-square exterior corner and a second non-square exterior corner, and trimming a portion of the book. The positioning of the trimmer block pad applies a distributed force to the book.

16 Claims, 3 Drawing Sheets

TRIMMER BLOCK PAD, TRIMMER, AND METHOD OF TRIMMING

FIELD OF THE INVENTION

The present invention is directed to book making systems and methods. More specifically, the present invention is directed to book making systems and methods including a block pad.

BACKGROUND OF THE INVENTION

Trimming of books is often automated and done at high speeds with high precision. Three-knife trimmers trim pages within a book to predetermined specifications. Known systems involve several layers of pads used for applying a force to the pages of the book during the trimming process. These layers are generally made of metal, wood, or cardboard.

When the knives cut through the pages of the book to trim them, these layers provide a template or profile for the cutting. Known systems suffer from the drawback that the layers of cardboard compress due to chemicals (for example, solvents and/or silicone spray) and other materials applied in liquid form to aid in the cutting process. The compression can be inconsistent (for example, based upon inconsistent exposure to chemicals), resulting in a non-uniform force being applied to the book or portions of the book while being positioned for trimming. This non-uniform force can result in chip-outs occurring on the book. In the past, splitter knives have been used to score the spine of books to reduce the number of chip-outs.

Likewise, chip-outs can result from unevenly and/or focused force being applied to the spine. To avoid this, known systems may be adjusted to apply a reduced force to the spine of the book while it is positioned for trimming. This reduced force may not have enough force to depress the spine, may undesirably adjust the angle of the profile, and/or may reduce the precision of the trimming.

What is needed is a trimmer block pad, trimmer, and method of trimming capable of reliably and consistently trimming books without forming chip-outs and capable of repeated use in the presence of chemicals.

SUMMARY OF THE INVENTION

One aspect of the present invention includes an apparatus including a trimmer block pad for forming a book. The trimmer block pad includes a first substantially square exterior corner connected by a first elongate exterior portion to a second substantially square exterior corner, a first non-square exterior corner connected by a second elongate exterior portion to the first substantially square exterior corner, and a second non-square exterior corner connected by a third elongate exterior portion to the second substantially square exterior corner. The first non-square exterior corner and the second non-square exterior corner are configured to apply a distributed force to the book. The first, second, and third elongate exterior portions are sized to define a trimmed portion of the book.

Another aspect of the present invention includes a trimmer block pad for forming a book. The trimmer block pad includes a first exterior corner connected by a first elongate portion to a second exterior corner, a third exterior corner connected by a second elongate portion to the first exterior corner, and a fourth exterior corner connected by a third elongate portion to the second exterior corner. The first, second, and third elongate portions are sized to define a trimmed portion of the book. The third exterior corner and the fourth exterior corner are configured to provide a distributed force to the book. The trimmer block pad comprises a thermoplastic material.

Another aspect of the present disclosure includes a process of forming a book. The process includes inserting the book into a trimmer, positioning a trimmer block pad to abut the book (the trimmer block comprising a first non-square exterior corner and a second non-square exterior corner), and trimming a portion of the book. The positioning of the trimmer block pad applies a distributed force to the book.

An advantage of the present disclosure includes reusability of block pads during a book trimming process.

Another advantage of the present disclosure includes chemical resistance of block pads used during a book trimming process.

Another advantage of the present disclosure includes the ability to apply a distributed force from a block pad to a book during a book trimming process.

Another advantage of the present disclosure includes the reduction or elimination of chip-outs during a book trimming process.

Another advantage of the present disclosure includes the reduction or elimination of using splitter knives during a book trimming process.

Another advantage of the present disclosure includes utilizing recyclable, recycled, or otherwise environmentally friendly materials.

Other features and advantages of the present invention will be apparent from the following more detailed description of the preferred embodiment, taken in conjunction with the accompanying drawings which illustrate, by way of example, the principles of the invention.

DETAILED DESCRIPTION OF THE INVENTION

Provided is a trimmer block pad, a trimmer, and a method of trimming for book making systems and methods.

Embodiments of the present disclosure can include reusability of block pads during a book trimming process, include chemical resistance of block pads used during a book trimming process, include the ability to apply a distributed or substantially uniform force from a block pad to a book during a book trimming process, include the ability to apply a force to a book from a block pad during a book trimming process, include the reduction or elimination of chip-outs during a book trimming process, and/or include the reduction or elimination of using splitter knives during a book trimming process.

Figure 1:
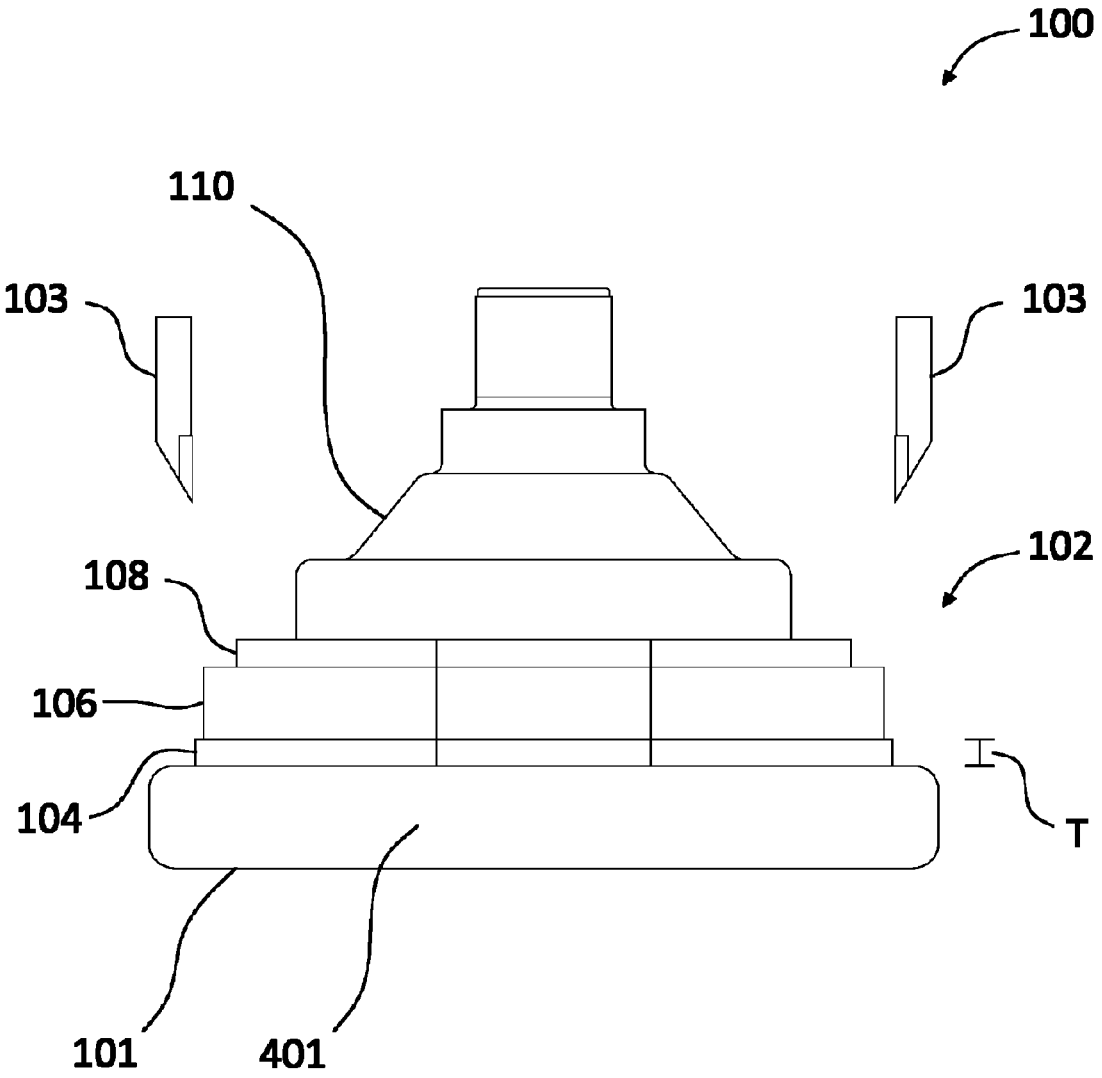
FIG. 1 shows a side view of a pressing block arrangement for a trimmer system including a trimmer block pad according to an exemplary embodiment of the disclosure.

FIG. 1 shows a portion of an exemplary trimmer system 100 including a pressing block arrangement 102 having a block pad 104 in accordance with exemplary embodiments disclosed herein. The system can otherwise be any suitable trimming system, and more specifically can be any three-knife trimming system as is known in the art. In one embodiment, the system 100 is used for a perfect-binding process as is understood by those skilled in the art. In another embodiment, the system 100 is used for a saddle-stitching process as is understood by those skilled in the art.

Figure 2:
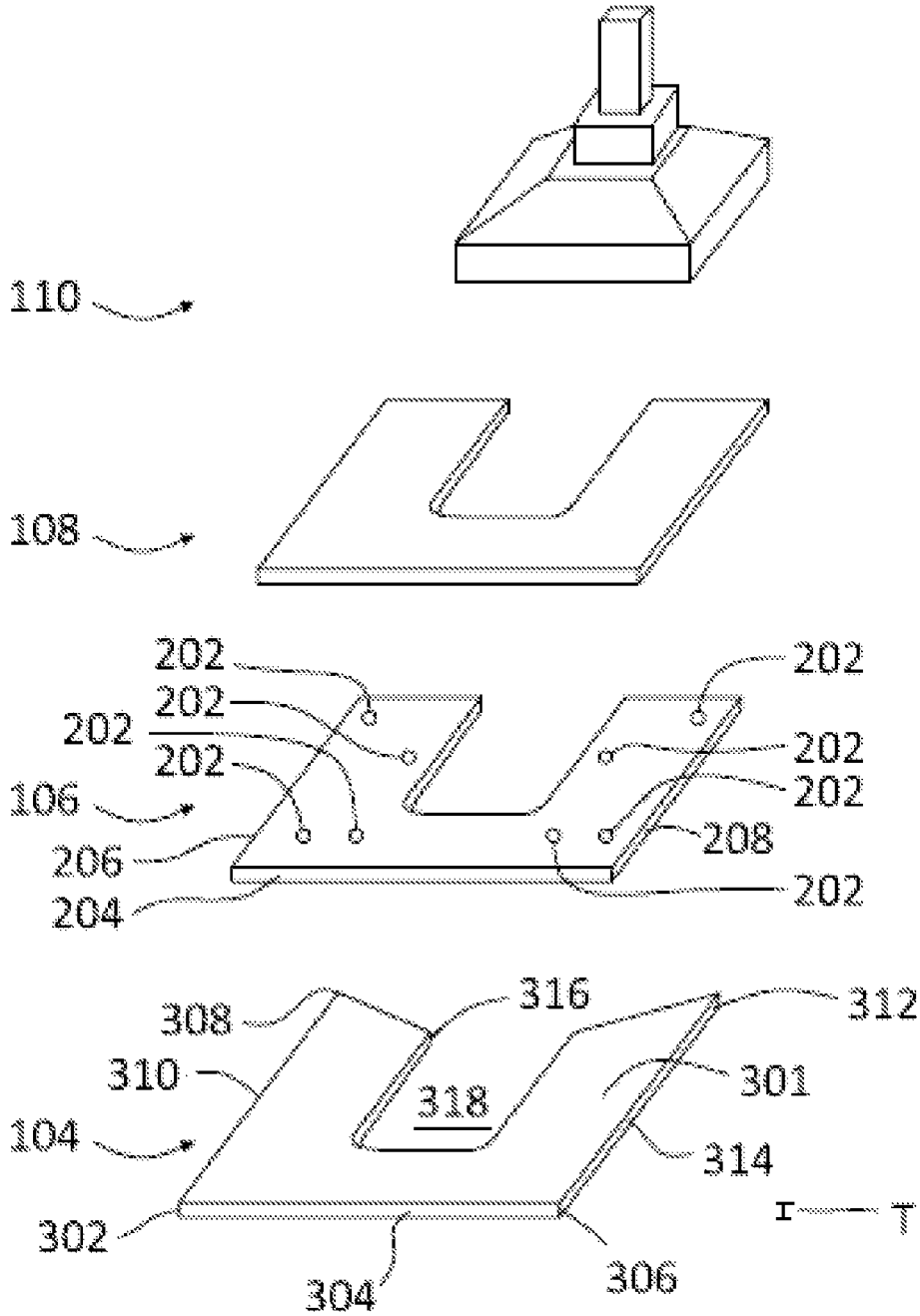
FIG. 2 shows an exploded perspective view of a pressing block for a trimmer system including a trimmer block pad according to an exemplary embodiment of the disclosure.

Referring to FIGS. 1 and 2, the pressing block arrangement 102 includes the block pad 104, a first plate 106 secured to the block pad 104, a second plate 108 secured to the first plate 106, and a pad holder 110 secured to the second plate 108. The pad holder 110 can be any suitable pad holder. The pad holder 110 is configured for being positioned/urged toward a book 101 to apply pressure to the book 101 from the block pad 104. As used herein, the term "book" includes any bound volume. For example, a book can be a soft-cover book, a hard-cover book, a magazine, a journal, etc. The side view of FIG. 1 shows a view of the pressing block arrangement 102 with a spine 401 of the book 101 toward the front. The exploded perspective view of FIG. 2 shows the pressing block arrangement 102 rotated 180 degrees so that the spine 401 of the book 101 would be positioned toward the rear.

The pad holder 110 can be configured for specific sizes and/or machines. The second plate 108 can be a metal plate (for example, steel) and/or can be configured for specific sizes and/or machines.

The first plate 106 can be secured with the second plate 108 by any suitable fastening or adhering mechanism. The first plate 106 can be a wood plate and/or can be configured for specific sizes and/or machines. In one embodiment, the first plate 106 is secured with the second plate 108 by mechanical fastening through countersinking to bore out holes (not shown) and pounding drive-in nuts 202 into the holes. In one embodiment, the first plate 106 includes a first elongate portion 204, a second elongate portion 206, and a third elongate portion 208. A first plate profile (not shown) formed by the first elongate portion 204, the second elongate portion 206, and the third elongate portion 208 substantially equals a profile (not shown) formed of the book 101 produced by the system 100, the profile of the book 101 being defined by edges of pages cut by the system 100.

The block pad 104 can be secured to the first plate 106 by any suitable fastening or adhering mechanism. In one embodiment, the block pad 104 is secured to the first plate 106 by an adhesive (for example, a tape adhesive or glue). The block pad 104 can be of any suitable material. In one embodiment, the material for the block pad 104 is selected to provide resistance to moisture (the moisture can include silicone spray, water, lubricant, solvent, combinations thereof, etc.). In another embodiment, the material for the block pad 104 is selected to provide solvent resistance and easy cleaning. The material of the block pad 104 can be solid and/or can include or be a thermoplastic such as high density polyethylene, acrylonitrile butadiene styrene, acrylic, celluloid, cellulose acetate, cycloolefin copolymer, ethylene-vinyl acetate, ethylene vinyl alcohol, fluoroplastics, ionomers, liquid crystal polymer, polyacetal, polyacrylates, polyacrylonitrile, polyamide, polyamide-imide, polyaryletherketone, polybutadiene, polybutylene, polybutylene terephthalate, polycaprolactone, polychlorotrifluoroethylene, polyethylene terephthalate, polycyclohexylene dimethylene terephthalate, polycarbonate, polyhydroxyalkanoates, polyketone, polyester, low density polyethylene, polyetheretherketone, polyetherketoneketone, polyetherimide, polyethersulfone, polyethylenechlorinates, polyimide, polylactic acid, polymethylpentene, polyphenylene oxide, polyphenylene sulfide, polyphthalamide, polypropylene, polystyrene, polysulfone, polytrimethylene terephthalate, polyurethane, polyvinyl acetate, polyvinyl chloride, polyvinylidene chloride, styrene-acrylonitrile, or combinations thereof. The material of the block pad 104 can be substantially devoid of cardboard, other bio-degradable materials, cellulosic materials, thermoset materials, and/or layered materials. For example, the material of the block pad 104 can be substantially devoid of polyester fiberglass, vulcanized rubber, phenol-formaldehyde resin, urea-formaldehyde, melamine resin, epoxy resin, polyimides, cyanate esters, polycyanurates, or combinations thereof.

In one embodiment, the block pad 104 can be sized larger than the profile of the book 101. In this embodiment, the block pad 104 is cut to size by one or more knives 103 (see FIG. 1) in the system 100 after being secured as part of the pressing block arrangement 200.

Figure 3:
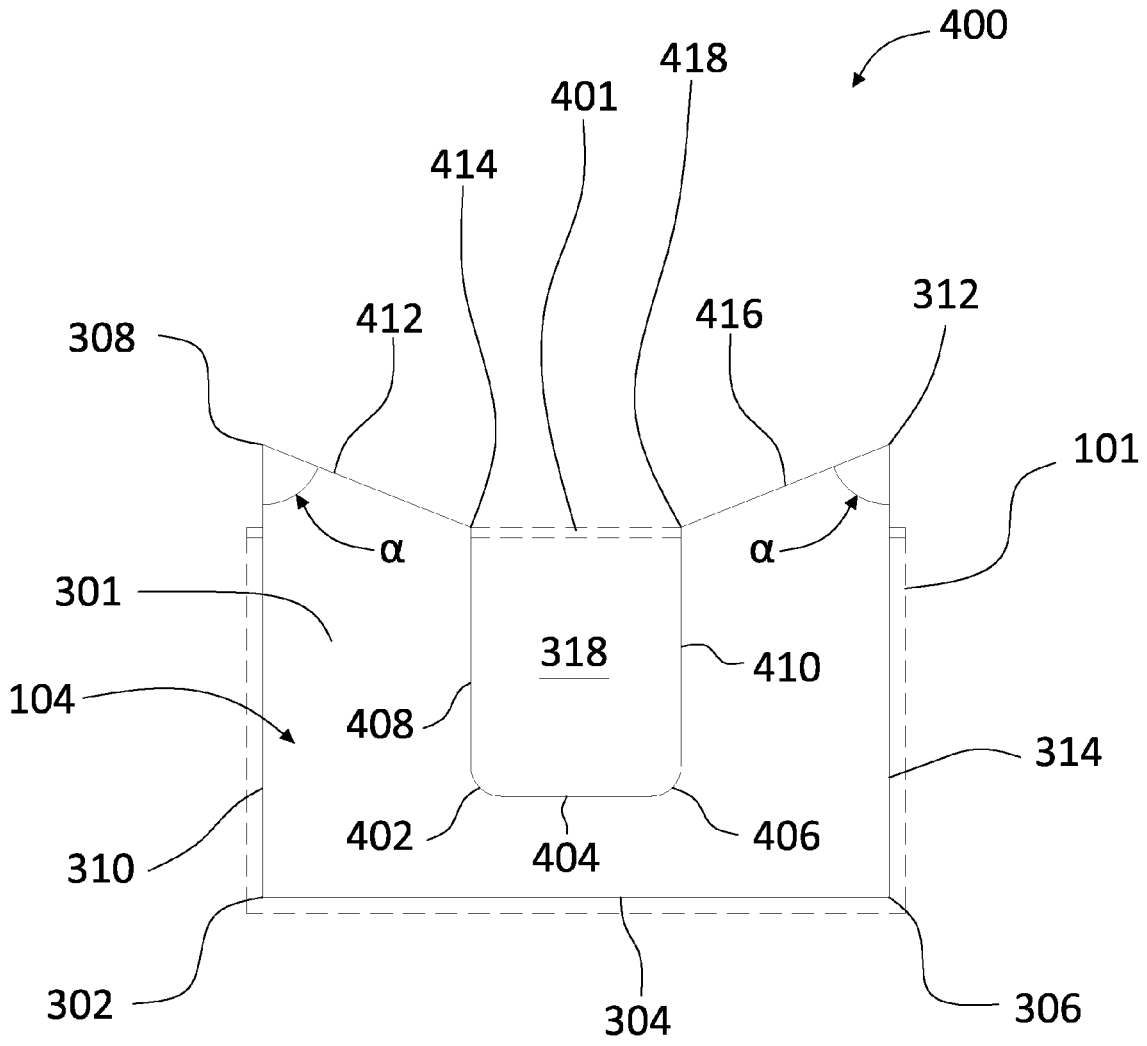
FIG. 3 shows a top view of a trimmer block pad for pressing a block of a trimmer system according to an exemplary embodiment of the disclosure.

The block pad 104 includes a profile 400 (see FIG. 3). The profile 400 is a top view of the block pad 104 showing a top surface 301 (see FIG. 2) of the block pad 104. A bottom surface (not shown) contacts the book 101 when the block pad 104 is positioned by the pressing block arrangement 200. The profile 400 includes a first substantially square exterior corner 302 connected by a first elongate portion 304 to a second substantially square exterior corner 306, a first non-square exterior corner 308 connected by a second elongate portion 310 to the first substantially square exterior corner 302, and a second non-square exterior corner 312 connected by a third elongate portion 314 to the second substantially square exterior corner 306. The first elongate portion 304, the second elongate portion 310, and the third elongate portion 314 can define a fore edge of the book 101. The fore edge can be at least a predetermined length and be at least a predetermined distance from the spine 401 of the book 101.

The block pad 104 includes a predetermined thickness T between the top surface 301 and the bottom surface. The predetermined thickness T can be any suitable thickness. For example, the predetermined thickness T can be based upon specific machine specifications. In one embodiment, the predetermined thickness T is about ¼ inch, ½ inch, or ¾ inch. In another embodiment, the predetermined thickness T can be modified by shaving, sanding, cutting, or otherwise removing a portion of the block pad 104. The predetermined thickness T can be substantially equal throughout the block pad 104 or can be substantially equal along the first substantially square exterior corner 302, the first elongate portion 304, the second substantially square exterior corner 306, the first non-square exterior corner 308, the second elongate portion 310, the second non-square exterior corner 312, and/or the third elongate portion 314. In this embodiment, the substantially equal predetermined thickness T forms a substantially square edge along the first substantially square exterior corner 302, the first elongate portion 304, the second substantially square exterior corner 306, the first non-square exterior corner 308, the second elongate portion 310, the second non-square exterior corner 312, and/or the third elongate portion 314. It is desirable that the profile 400 is arranged to apply a distributed and/or substantially uniform amount of force against the book 101 when the pressing block arrangement 102 is positioned/urged to secure the book 101 for trimming.

Referring to FIG. 2, in one embodiment, one or more portions of the block pad can include a curved or radius edge 316 (for example, a beveled edge). The curved or radius edge 316 can be in an interior region 318 (for example, an opening) of the block pad 104. The curved or radius edge 316 in the interior region 318 can be positioned on the bottom surface (not shown) and oriented downward to abut the book 101.

FIG. 3 shows the profile 400 of the block pad 104, which can form the profile for the book 101 to be formed by a three-knife trimmer (i.e., the top, bottom and fore edge of the pages of the finished book). As shown in FIG. 3, prior to being cut, the book 101 (shown pre-trimmed in FIG. 3) can be larger than the profile 400. Likewise, the block pad 104 can extend beyond all or a portion of the spine 401 of the book 101. The first elongate portion 304 can be sized to correspond to a portion of the book 101 to be trimmed (for example, a desired length of a fore edge of the book 101). For example, in a book having pages that are about 8½ inches by about 11 inches, the first elongate portion 304 can be about 11 inches. The second elongate portion 310 and the third elongate portion 314 can be substantially equal in length but longer than the portion of the book 101 to be trimmed (for example, pages of the book). For example, in the book having pages that are about 8½ inches by about 11 inches, the second elongate portion 310 can be about 8¾ inches and the third elongate portion 314 can be about 8¾ inches. Additionally or alternatively, the first non-square exterior corner 308 and/or the second non-square exterior corner 312 can extend beyond the portion of the book 101 to be trimmed.

The second elongate portion 310 and the third elongate portion 314 can be exactly parallel or substantially parallel. As such, the first elongate portion 304 can be exactly perpendicular or substantially perpendicular to the second elongate portion 310 and/or the third elongate portion 314. The interior region 318 can include a first interior corner 402 connected by a first interior elongate portion 404 to a second interior corner 406. The first interior elongate portion 404 can be smaller than and parallel to the first elongate portion 304. The first interior elongate portion 404 can include the radius edge 316 (see FIG. 2). A second interior elongate portion 408 can extend from the first interior corner 402 and a third interior elongate portion 410 can extend from the second interior corner 406. The second interior elongate portion 408 and/or the third interior elongate portion 410 can be smaller than and parallel to the second elongate portion 310 and/or the third elongate portion 314. The second interior elongate portion 408 and/or the third interior elongate portion 410 can include the radius edge 316.

The non-square exterior corners 308, 312 cannot be 90 degree angles. In one embodiment, the non-square exterior corners 308, 312 are each less than 90 degrees (for example, about a 75 degree angle) (see angle $\alpha$ of FIG. 3). The non-square exterior corners 308, 312 can prevent the spine 401 from crushing during the trimming process. For example, if the non-square exterior corners 308, 312 are less than 90 degree angles, then the non-square exterior corners 308, 312 extend beyond the spine 401 during the trimming process thereby distributing force over a greater portion of the spine 401. In this embodiment, the outermost portions of the block pad 104 extend inward toward the interior region 318 along a first non-parallel elongate portion 412 and a second non-parallel elongate portion 416, respectively.

The first non-parallel elongate portion 412 extends from the first non-square exterior corner 308 toward the interior region 318 and a first interior region corner 414. The first non-parallel elongate portion 412 is not parallel to the first elongate portion 304 and/or is not perpendicular to the second elongate portion 310. Likewise, the second non-parallel elongate portion 416 extends from the second non-square exterior corner 312 toward the interior region 318 and a second interior region corner 418. The second non-parallel elongate portion 416 is not parallel to the first elongate portion 304 and/or is not perpendicular to the third elongate portion 314.

Applying force to the book 101 during the trimming process by using the block pad 104 has resulted in substantial improvements in trimming operation. For example, use of the block pad 104 in trimming processes has permitted the trimming process to be executed without the use of splitter knives frequently and traditionally used for scoring the back of a book to reduce chip-out problems.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

The invention claimed is:

1. An apparatus comprising a trimmer block pad for forming a book, the trimmer block pad comprising:

a first substantially square exterior corner connected by a first elongate exterior portion to a second substantially square exterior corner;

a first non-square exterior corner directly connected by a second elongate exterior portion to the first substantially square exterior corner; and a second non-square exterior corner directly connected by a third elongate exterior portion to the second substantially square exterior corner;

wherein the first non-square exterior corner and the second non-square exterior corner are configured to apply a distributed force to the book;

wherein the first, second, and third elongate exterior portions are sized to define a trimmed portion of the book;

wherein the first non-square exterior corner is directly connected by a first diagonal edge to a first corner of a recess of the trimmer block pad;

wherein the second non-square exterior corner is directly connected by a second diagonal edge to a second corner of the recess of the trimmer block pad.

2. The apparatus of claim 1, wherein the trimmer block pad includes a thermoplastic material.

3. The apparatus of claim 1, wherein the second elongate portion and the third elongate portion extend beyond a portion of the book.

4. The apparatus of claim 1, wherein the first non-square exterior corner and the second non-square exterior corners each have an angle of less than about 90 degrees.

5. The apparatus of claim 1, wherein the first non-square exterior corner and the second non-square exterior corners each have an angle of about 75 degrees.

6. The apparatus of claim 1, wherein the trimmer block pad comprises an interior region, the interior region comprising a first elongate interior portion, a second elongate interior portion extending from the first elongate interior portion toward a spine of the book, and a third elongate interior portion extending from the first elongate interior portion toward the spine of the book.

7. The apparatus of claim 6, wherein the first elongate interior portion, the second elongate interior portion, and the third elongate interior portion each include a radius edge.

8. The apparatus of claim 1, wherein the trimmer block comprises a first non-parallel elongate portion extending from the first non-square exterior corner and a second non-parallel elongate portion extending from the second non-square exterior corner, the first non-parallel elongate portion and the second non-parallel elongate portion not being parallel to the first elongate portion.

9. The apparatus of claim 1, wherein the distributed force is substantially uniform.

10. A pressing block including the trimmer block pad of claim 1, the pressing block comprising:

the trimmer block pad;

a first plate secured to the trimmer block pad;

a second plate secured to the first plate; and a pad holder secured to the second plate;

wherein the pad holder is configured for being positioned to apply the force to the book from the trimmer block pad.

11. A trimmer system including the pressing block of claim 10.

12. A trimmer block pad for forming a book, the trimmer block pad comprising:

a first exterior corner connected by a first elongate portion to a second exterior corner;

a third exterior corner connected by a second elongate portion to the first exterior corner; and a fourth exterior corner connected by a third elongate portion to the second exterior corner;

wherein the first, second, and third elongate portions are sized to define a trimmed portion the book;

wherein the third exterior corner and the fourth exterior corner are configured to provide a distributed force to the book;

wherein the first exterior corner is non-square and directly connected by a first diagonal edge to a first corner of a recess of the trimmer block pad;

wherein the second exterior corner is non-square and directly connected by a second diagonal edge to a second corner of the recess of the trimmer block pad.

13. The trimmer block pad of claim 12, further comprising an interior region, the interior region comprising a first interior elongate portion, a second interior elongate portion extending from the first interior elongate portion, and a third interior elongate portion extending from the first interior elongate portion.

14. The trimmer block pad of claim 13, wherein the first interior elongate portion, the second interior elongate portion, and the third interior elongate portion each include a radius edge.

15. The trimmer block pad of claim 12, wherein the first exterior corner is a first substantially square exterior corner, the second exterior corner is a second substantially square exterior corner, the third exterior corner is a first non-square exterior corner, and the fourth exterior corner is a second non-square exterior corner.

16. The trimmer block pad of claim 12, wherein the second elongate portion and the third elongate portion extend beyond a portion of the book.

* * * * *